US006241413B1

(12) United States Patent
Puck et al.

(10) Patent No.: US 6,241,413 B1
(45) Date of Patent: Jun. 5, 2001

(54) GOLF-THEME WRITING RELATED ARTICLES

(76) Inventors: Sonny Ah Puck; Johnna Ah Puck, both of 54-121 Imua Pl., Hauula, HI (US) 96717

( * ) Notice: Subject to any disclaimer, the term of this patent is extended or adjusted under 35 U.S.C. 154(b) by 0 days.

(21) Appl. No.: 09/523,128

(22) Filed: Mar. 10, 2000

Related U.S. Application Data

(60) Provisional application No. 60/124,335, filed on Mar. 15, 1999.

(51) Int. Cl.[7] ..... B43K 23/02

(52) U.S. Cl. ..... 401/131; 401/195; 401/52; D19/81; D19/82; D19/84; 15/427; 15/428

(58) Field of Search ..... 401/131, 195, 401/52; D19/81, 82, 84, 85, 53, 77; 15/424, 427, 428; D3/206; 206/371, 457, 224

(56) References Cited

U.S. PATENT DOCUMENTS

| | | | | |
|---|---|---|---|---|
| D. 275,744 | | 10/1984 | McJunkin . | |
| D. 344,547 | | 2/1994 | Tietje . | |
| D. 354,311 | * | 1/1995 | Tarozzi | D19/82 |
| D. 355,218 | * | 2/1995 | Peterka | D19/82 |
| D. 368,036 | | 3/1996 | Tronolone . | |
| D. 381,044 | | 7/1997 | Larm . | |
| D. 383,781 | | 9/1997 | Buckner . | |
| 1,257,383 | * | 2/1918 | Olson | 401/52 |
| 2,497,418 | * | 2/1950 | Schroeder, Jr. | D19/81 |
| 3,212,146 | * | 10/1965 | Morgan | D19/82 |
| 5,619,814 | * | 4/1997 | Herndobler | D19/82 |

* cited by examiner

*Primary Examiner*—David J. Walczak

(57) ABSTRACT

A golf-theme writing related article includes a golf-club-head-shaped eraser which includes a pencil-end reception well for receiving an eraser end of a pencil. A golf-club-bag-shaped pencil holder is provided for holding one or more of pencils fitted with the golf-club-head-shaped erasers. A simulated wheeled golf bag cart is provided for supporting the golf-club-bag-shaped pencil holder. The simulated wheeled golf bag cart includes wheels and a bag-holder portion supported by the wheels. The simulated wheeled golf bag cart includes two wheels. Alternatively, the simulated wheeled golf bag cart includes three wheels, and the wheels weigh more than the bag-holder portion. A simulated golf green is provided for supporting the simulated wheeled golf bag cart on which the golf-club-bag-shaped pencil holder is supported. Additional golf-club-head-shaped erasers and are provided. Each golf-club-head-shaped eraser can simulate a different head of a golf club.

6 Claims, 3 Drawing Sheets

FIG 5
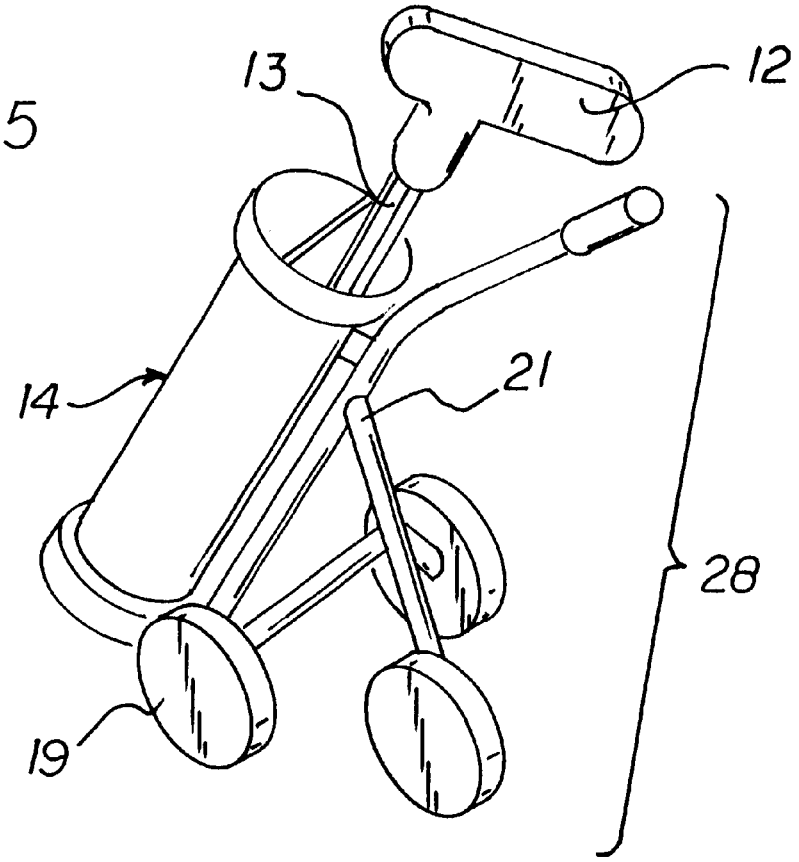
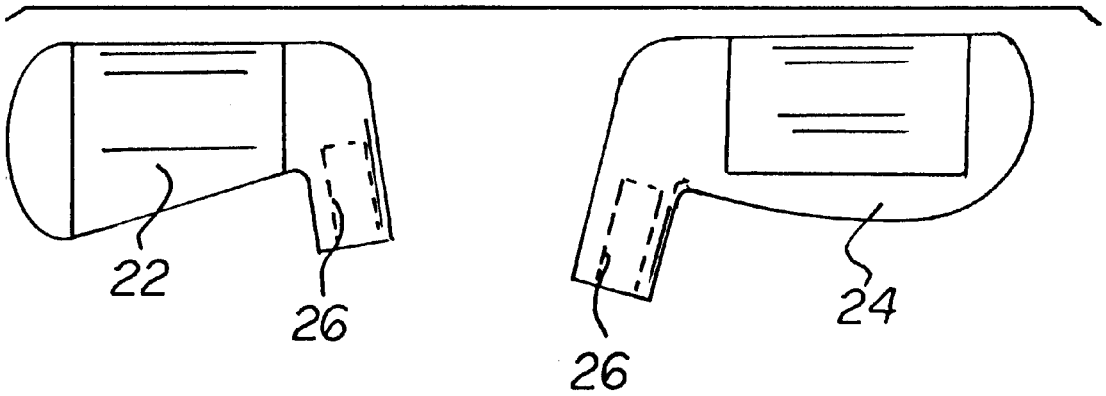
FIG 6

GOLF-THEME WRITING RELATED ARTICLES

CROSS REFERENCE TO RELATED APPLICATION

This application claims priority based upon my copending Provisional Application Serial No. 60/124,335, filed Mar. 15, 1999.

BACKGROUND OF THE INVENTION

1. Field of the Invention

The present invention relates generally to writing related articles and, more particularly, to writing related articles that are in accordance with a theme relating to the game of golf.

2. Description of the Prior Art

When people sit at a desk working, their minds often turn to the pleasant experiences of recreation. For many people, the game of golf is a much appreciated form of recreation. In this respect, throughout the years, a number of innovations have been developed relating to items generally retained on a desk that exhibit some feature connected with the game of golf, and the following U.S. patents are representative of some of those innovations: Des. Pat. No. 275,744, Des. Pat. No. 344,547, Des. Pat. No. 381,044, Des. Pat. No. 368,036, and Des. Pat. No. 383,781. More specifically, U.S. Pat. No. Des. 275,744 discloses a golf trophy in which a writing implement is inserted into a portion of a simulated golf club. For purposes of simplicity of manufacture, it would be desirable if a writing implement were not inserted into a simulated golf club handle, but, instead, it would be desirable if a writing implement itself served as the handle of a simulated golf club.

U.S. Pat. No. Des. 344,547 discloses a desk organizer that has a flat base with wells for receiving writing implements and that has a simulated golf ball resting on the base. Although a golf ball certainly conveys a theme of the game of golf, it would be desirable if desk items conveying the theme of golf included golf-related items beyond simply a golf ball.

U.S. Pat. No. Des. 381,044 discloses a combined writing implement desk set and business card holder which includes a golf ball on a flat base. It is noted, however, that the writing implement itself has no feature relating to the theme of golf. In this respect, it would be desirable if a desk set were provided in which a writing implement, in conjunction with the desk set, exhibited a feature connected with the theme of golf.

U.S. Pat. No. Des. 368,036 disclose a desk set which includes features simulating a golf club. There are, however, a number of other articles associated with the theme of golf other than a golf club. For example, a golf club bag is associated with the game of golf. In this respect, it would be desirable if a desk set were provided that included a simulation of a golf club bag.

U.S. Pat. No. Des. 383,781 discloses a page turning device that has a simulated golf ball placed on the non-writing end of a writing implement. It is noted, however, that if a simulated golf club head were placed on the non-writing end of a writing implement, the combination of the writing implement and the simulated golf club head would give the appearance of a simulated golf club. In this respect, it would be desirable if a desk set article were provided in which the combination of a writing implement and a simulated golf club head placed on the non-writing end of the writing implement would give the appearance of a simulated golf club.

Still other features would be desirable in a golf-theme writing related articles such as used on a desk set. For example, another article associated with the game of golf is a golf cart. In this respect, it would be desirable if a desk set for writing implements included a simulated golf cart. Still another feature of a golf game is the green on which the holes are located. In this respect, it would be desirable if a desk set for writing implements included a simulated golf green.

Thus, while the foregoing body of prior art indicates it to be well known to use desk sets having articles that relate to the theme of golf, the prior art described above does not teach or suggest golf-theme writing related articles which have the following combination of desirable features: (1) the writing implement itself serves as the handle of a simulated golf club; (2) desk items conveying the theme of golf include golf-related items beyond simply a golf ball; (3) a writing implement, in conjunction with a desk set, exhibits a feature connected with the theme of golf; (4) includes a simulation of a golf club bag; (5) the combination of a writing implement and a simulated golf club head placed on the non-writing end of the writing implement give the appearance of a simulated golf club; (6) includes a simulated golf cart; and (7) includes a simulated golf green. The foregoing desired characteristics are provided by the unique golf-theme writing related articles of the present invention as will be made apparent from the following description thereof. Other advantages of the present invention over the prior art also will be rendered evident.

SUMMARY OF THE INVENTION

To achieve the foregoing and other advantages, the present invention, briefly described, provides a golf-theme writing related article which includes a golf-club-head-shaped eraser which includes a pencil-end reception well for receiving an eraser end of a pencil. A golf-club-bag-shaped pencil holder is provided for holding one or more of pencils fitted with the golf-club-head-shaped erasers. A simulated wheeled golf bag cart is provided for supporting the golf-club-bag-shaped pencil holder. The simulated wheeled golf bag cart includes wheels and a bag-holder portion supported by the wheels. The simulated wheeled golf bag cart includes two wheels. Alternatively, the simulated wheeled golf bag cart includes three wheels, and the wheels weigh more than the bag-holder portion.

A simulated golf green is provided for supporting the simulated wheeled golf bag cart on which the golf-club-bag-shaped pencil holder is supported. Additional golf-club-head-shaped erasers and are provided. Each golf-club-head-shaped eraser can simulate a different head of a golf club.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least four preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide new and improved golf-theme writing related articles which have all of the advantages of the prior art and none of the disadvantages.

It is another object of the present invention to provide new and improved golf-theme writing related articles which may be easily and efficiently manufactured and marketed.

It is a further object of the present invention to provide new and improved golf-theme writing related articles which are of durable and reliable construction.

An even further object of the present invention is to provide new and improved golf-theme writing related articles which are susceptible of a low cost of manufacture with regard to both materials and labor, and which accordingly are then susceptible of low prices of sale to the consuming public, thereby making such golf-theme writing related articles available to the buying public.

Still yet a further object of the present invention is to provide new and improved golf-theme writing related articles in which a writing implement itself serves as the handle of a simulated golf club.

Still another object of the present invention is to provide new and improved golf-theme writing related articles that convey the theme of golf beyond simply a golf ball.

Yet another object of the present invention is to provide new and improved golf-theme writing related articles in which a writing implement, in conjunction with a desk set, exhibits a feature connected with the theme of golf.

Even another object of the present invention is to provide new and improved golf-theme writing related articles that include a simulation of a golf club bag.

Still a further object of the present invention is to provide new and improved golf-theme writing related articles in which the combination of a writing implement and a simulated golf club head placed on the non-writing end of the writing implement gives the appearance of a simulated golf club.

Yet another object of the present invention is to provide new and improved golf-theme writing related articles that include a simulated golf cart.

Still another object of the present invention is to provide new and improved golf-theme writing related articles which include a simulated golf green.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is an enlarged perspective view of a fourth embodiment of the golf-theme writing related articles of the invention wherein a golf-club-bag-shaped pencil holder is fixed on a simulated wheeled golf bag cart that has three wheels.

FIG. 6 illustrate additional golf-club-head-shaped erasers that can be fitted to the end of a pencil, such as shown in FIG. 2.

DESCRIPTION OF THE PREFERRED EMBODIMENT

With reference to the drawings, new and improved golf-theme writing related articles embodying the principles and concepts of the present invention will be described.

Figure 1:
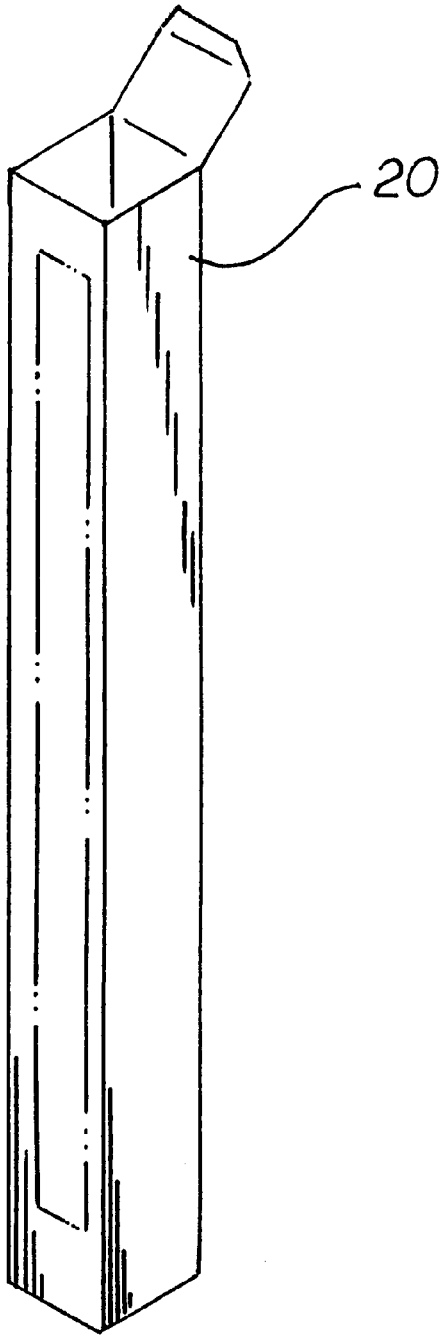
FIG. 1 is a perspective view showing a long box that is capable of packaging an actual golf club and that is used for packaging the golf-theme writing related articles of the invention.
Figure 2:
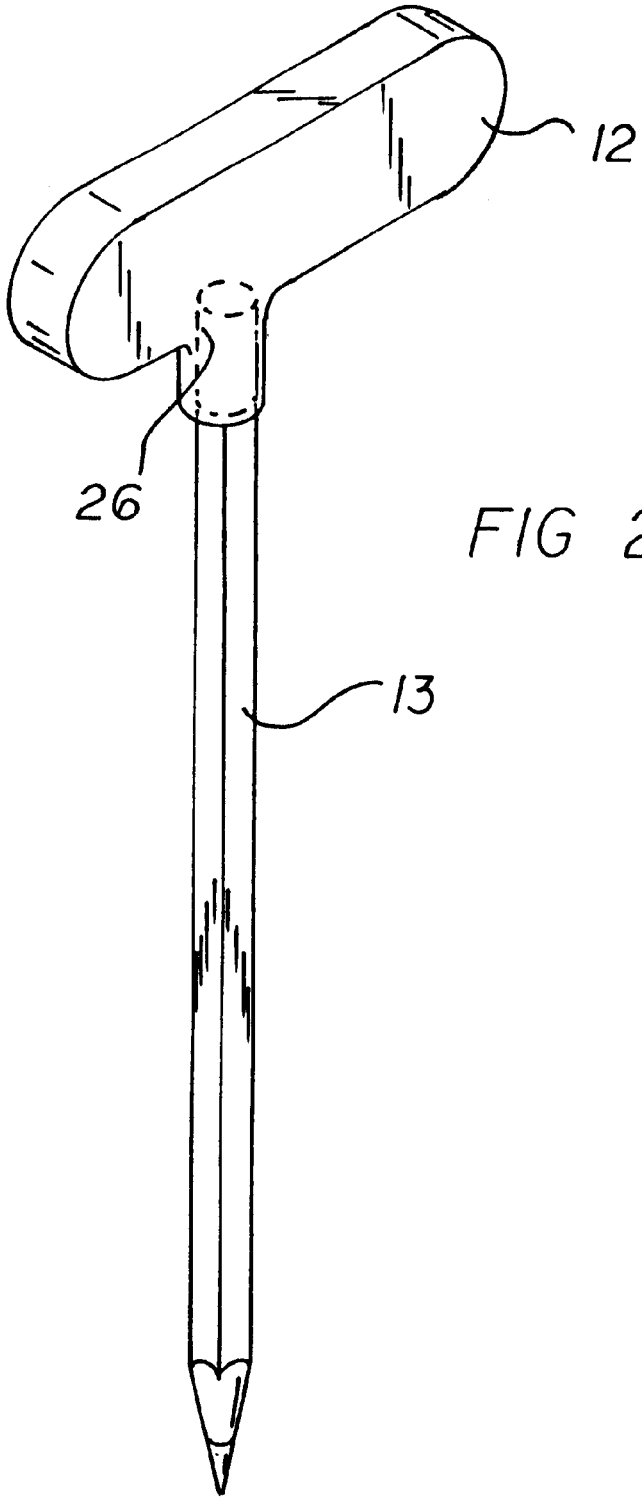
FIG. 2 is a perspective view of a first embodiment of the golf-theme writing related articles of the invention which includes a golf-club-head-shaped eraser fitted to an end of a pencil.
Figure 4:
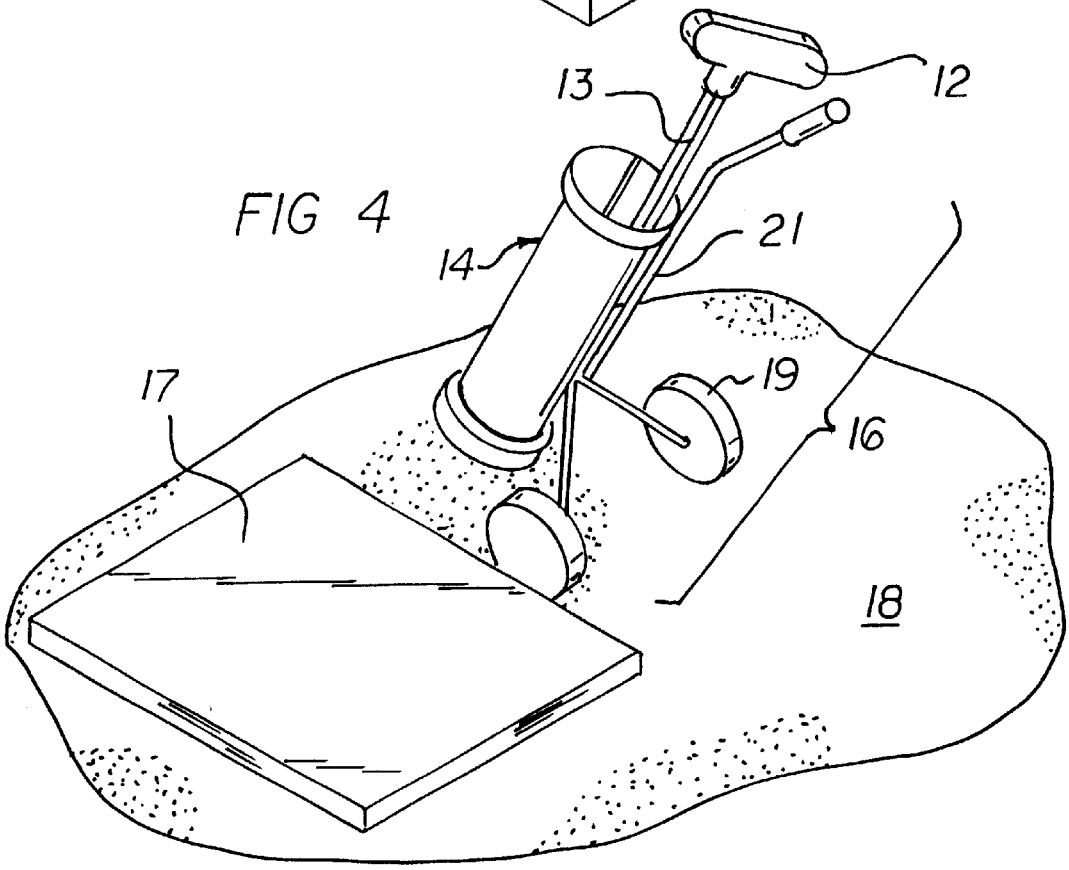
FIG. 4 is a perspective view of a third embodiment of the golf-theme writing related articles of the invention which includes a golf-club-bag-shaped pencil holder fixed on a simulated wheeled golf bag cart resting on a simulated golf green on which a writing pad is resting, wherein the simulated wheeled golf bag cart includes two wheels.

Turning to FIG. 2, a golf-theme writing related article includes a golf-club-head-shaped eraser 12 which includes a pencil-end reception well 26 for receiving an eraser end of a pencil 13. A golf-club-bag-shaped pencil holder 14 is provided for holding one or more of pencils 13 fitted with the golf-club-head-shaped erasers 12. A simulated wheeled golf bag cart 16 is provided for supporting the golf-club-bag-shaped pencil holder 14. The simulated wheeled golf bag cart 16 includes wheels 19, and a bag-holder portion 21 supported by the wheels 19. As shown in FIG. 4, the simulated wheeled golf bag cart 16 includes two wheels. As shown in FIG. 5, the simulated wheeled golf bag cart 28 includes three wheels, and the wheels 19 weigh more than the bagholder portion 21.

As shown in FIG. 4, a simulated golf green 18 is provided for supporting the simulated wheeled golf bag cart 16 on which the golf-club-bag-shaped pencil holder 14 is supported.

As shown in FIG. 6, additional golf-club-head-shaped erasers 22 and 24 are provided. Each golf-club-head-shaped eraser can represent a different head of a golf club.

The golf-theme writing related articles can be regarded as a novelty item. In packaging the golf-theme writing related articles, the articles can be contained in the box 20. More specifically, the box 20 is long enough to package a real golf club. For example, the box 20 can be about 3 or 4 inches square and from 3½ to 4 feet long. The box 20 can have a picture of a golf club on the outside, and descriptive words should also be on the outside of the box 20. For example, the following words can be printed on the outside of the box 20. "The Ultimate Golf Club! Guaranteed to lower your score on any course, in any weather, and during any time of the day." Also, the outside of the box can have a description of a club, as follows, "This club is made of special materials aluminum, graphite, wood, and rubber." The box can have this statement too, "The secret is in the club." The actual contents of the box 20 would includes the complete group of the golf-theme writing related articles of the invention set forth in the drawings. More specifically, the contents of the box 20 would includes a pencil 13. A golf-club-head-shaped eraser 12, and one or more of the choices of the golf-club-bag-shaped pencil holders 14, the simulated wheeled golf bag cart 16 having two wheels, the simulated wheeled golf bag cart 28 having three wheels, writing paper holder 15, the writing pad 17, the simulated golf green 18, and the additional golf-club-head-shaped erasers 22 and 24.

The pencil 13 can come in different colors, prints, and sizes. The pencil 13, which represents a golf club handle, can be personalized with a consumer's name or a company's name. Each of the golf-club-head-shaped erasers 12 includes a pencil-end reception well 26 which can fit over either a permanent-eraser-included end of a pencil 13, or an end of a pencil 13 which does not includes an eraser. Three shapes of the golf-club-head-shaped eraser 12 are shown in the drawings, one shape in FIGS. 2–5, and two additional shapes in FIG. 6. More specifically, the golf-club-head-shaped erasers can have a wide variety of shapes such as a golf putter, driver, six or nine iron, etc.

Figure 3:
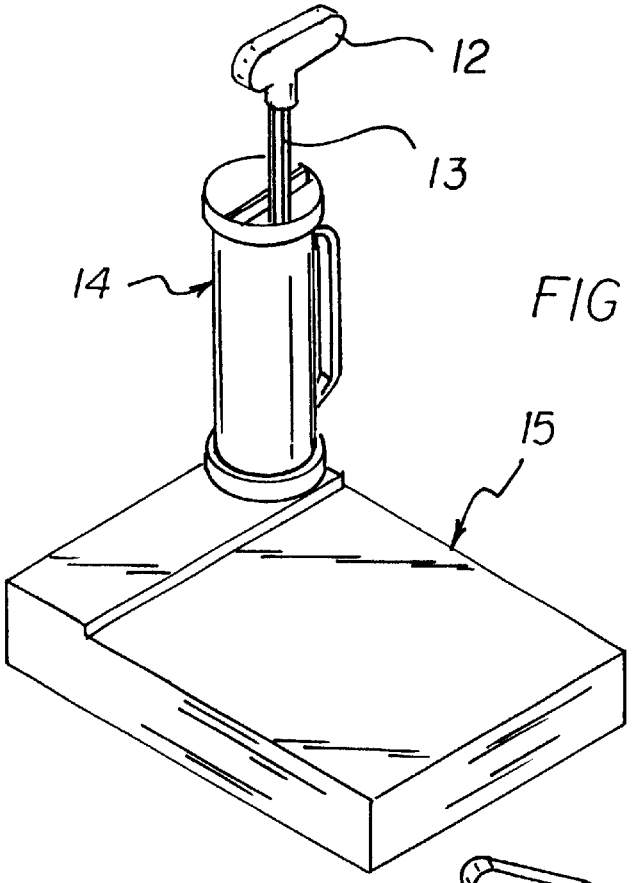
FIG. 3 is a perspective view of a second embodiment of the golf-theme writing related articles of the invention which includes a golf-club-bag-shaped pencil holder sitting on a writing paper holder.

The golf-club-bag-shaped pencil holder 14, as shown in the drawings, can have a variety of styles. As shown in FIG. 3, the golf-club-bag-shaped pencil holder 14 can be in the form of an upright golf club bag which is attached to the upper right hand comer of the writing paper holder 15. The golf-club-bag-shaped pencil holder 14 receives a number of pencil/golf-club-head-shaped eraser combinations which simulate golf clubs.

As shown in FIG. 4, a simulated golf green 18 can be provided. The combination of the golf-club-bag-shaped pencil holder 14 and the simulated wheeled golf bag cart 16 rest on the simulated golf green 18. A writing pad 17 also rests on the simulated golf green 18.

As shown in FIG. 5, there is a combination of the golf-club-bag-shaped pencil holder 14 and a simulated wheeled golf bag cart 28 which has three weighted wheels 19 affixed to the bag-holder portion 21.

The components of the golf-theme writing related articles of the invention can be made from inexpensive and durable paper, wood, metal, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing new and improved golf-theme writing related articles that are low in cost, relatively simple in design and operation, and which may advantageously be used to serve as the handle of a simulated golf club. With the invention, golf-theme writing related articles are provided in which desk items conveying the theme of golf include golf-related items beyond simply a golf ball. With the invention, golf-theme writing related articles are provided in which the combination of a writing implement and a desk set exhibit a feature connected with the theme of golf. With the invention, golf-theme writing related articles are provided which include a simulation of a golf club bag. With the invention, golf-theme writing related articles are provided in which the combination of a writing implement and a simulated golf club head placed on the non-writing end of the writing implement gives the appearance of a simulated golf club. With the invention, golf-theme writing related articles are provided which include a simulated golf cart. With the invention, golf-theme writing related articles are provided which include a simulated golf green.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A golf-theme writing related article, comprising:

a golf-club-head-shaped eraser which includes a pencil-end reception well, said eraser having at least one substantially flat surface to simulate the club face hitting surface of an actual golf club, said reception well comprising a generally cylindrical receptacle for simulating the club shaft reception well of an actual golf club, wherein said reception well has a central axis, said central axis extending transversely with respect to the plane of said substantially flat surface whereby said eraser simulates the configuration of an actual golf club when a pencil is received in said pencil-end reception well, said article further including a golf-club-bag-shaped pencil holder for holding said pencil fitted with said golf-club-head-shaped eraser, wherein said golf-club-bag-shaped pencil holder comprises a substantially hollow tubular member having a closed bottom end and a remotely opposed annular top open end to simulate an actual golf bag, said pencil fitted with said golf-club-head-shaped eraser adapted to be received within said tubular member through said top open end with said eraser extending above said tubular member top open end to simulate an actual golf club in an actual golf bag, and a simulated wheeled golf bag cart for supporting said golf-club-bag-shaped pencil holder.

2. The article of claim 1 wherein said simulated wheeled golf bag cart includes wheels and a bag-holder portion supported by said wheels, and wherein said wheels weigh more than said bag-holder portion.

3. The article of claim 2 wherein said simulated wheeled golf bag cart includes two wheels.

4. The article of claim 2 wherein said simulated wheeled golf bag cart includes three wheels.

5. A set of golf-theme writing related articles, comprising in combination:

a golf-club-head-shaped eraser which includes a pencil-end reception well, said eraser having at least one substantially flat surface to simulate the club face hitting surface of an actual golf club, said reception well comprising a generally cylindrical receptacle for simulating the club shaft reception well of an actual golf club, wherein said reception well has a central axis, said central axis extending transversely with respect to the plane of said substantially flat surface whereby said eraser simulates the configuration of an actual golf club when a pencil is received in said pencil-end reception well with said pencil simulating the shaft of an actual golf club, a golf-club-bag-shaped pencil holder for holding a pencil fitted with said golf-club-head-shaped eraser, said golf-club-bag-shaped pencil holder comprising a substantially hollow tubular member having a closed bottom end and a remotely opposed annular top open end to simulate an actual golf bag, said pencil fitted with said golf-club-head-shaped eraser adapted to be received within said tubular member through said top open end with said eraser extending above said tubular member top open end to simulate an actual golf club in an actual golf bag, a simulated wheeled golf bag cart for supporting said golf-club-bag-shaped pencil holder, and a simulated golf green for supporting said simulated wheeled golf bag cart on which said golf-club-bag-shaped pencil holder is supported.

6. The set of articles of claim 5 wherein said simulated wheeled golf bag cart includes wheels and a bag-holder portion supported by said wheels, and wherein said wheels weigh more than said bag-holder portion.

* * * * *